US009790058B1

(12) United States Patent
Sandrowski

(10) Patent No.: US 9,790,058 B1
(45) Date of Patent: Oct. 17, 2017

(54) SPREADER FRAME

(71) Applicant: Bjorn Reiner Sandrowski, Edmonton (CA)

(72) Inventor: Bjorn Reiner Sandrowski, Edmonton (CA)

( * ) Notice: Subject to any disclaimer, the term of this patent is extended or adjusted under 35 U.S.C. 154(b) by 0 days.

(21) Appl. No.: 15/217,913

(22) Filed: Jul. 22, 2016

(51) Int. Cl.
*B66C 1/10* (2006.01)

(52) U.S. Cl.
CPC ..... *B66C 1/10* (2013.01); *B66C 1/101* (2013.01)

(58) Field of Classification Search
CPC ..... B66C 1/10; B66C 1/101; B66C 1/663; B66C 1/16; F16B 7/105; F16B 7/14
USPC ..... 294/81.2, 81.21, 81.5, 67.1; 403/379.5, 403/379.6, 109.3
See application file for complete search history.

(56) References Cited

U.S. PATENT DOCUMENTS 1,846,038 A * 2/1932 Owens ..... B66C 1/663 294/81.21
1,970,617 A * 8/1934 Morgan ..... B66C 1/663 294/74
3,502,364 A * 3/1970 Moore ..... B66C 1/16 294/67.1
8,764,082 B2 * 7/2014 Krogh ..... B66C 1/108 294/67.33

OTHER PUBLICATIONS

"AD37000B-1PA Adjustable Frame With Sling," © 2016 Tandemloc, Inc., Havelock, N.C., <http://www.tandemloc.com/lifting-spreader-frames-AD37000B-1PA.asp> [retrieved May 25, 2016], 2 pages.
"Spreader Frames & Multi-Point Lifts," © 2013-2017 Modulift, <http://www.modulift.com/spreaderframesmultipointlifts> [retrieved May 25, 2016], 8 pages.

* cited by examiner

*Primary Examiner* — Dean Kramer
(74) *Attorney, Agent, or Firm* — Christensen O'Connor Johnson Kindness PLLC

(57) ABSTRACT

A spreader frame, comprising a set of outer bars and a corresponding set of inner bars, each outer bar having a series of apertures and each inner bar having a spring-biased pin shaped and oriented to fit into any aperture of the series of apertures, each inner bar slidably engaging each corresponding outer bar to form an expandable beam having a first end and a second end, and each beam being connected at its first end and second end to a further beam to form a frame, wherein for each beam, each aperture of the series of apertures other than a selected aperture is filled with a corresponding outer bar pin, and the inner bar is slidable within the outer bar to bring the spring-biased pin in position to insert into the selected aperture to fix the size of the beam.

20 Claims, 11 Drawing Sheets

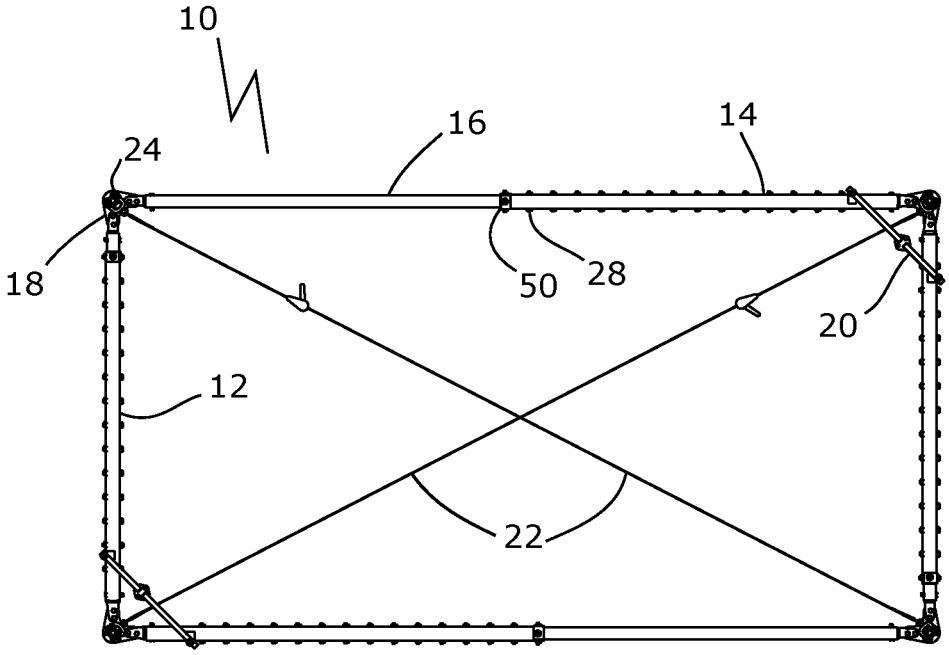
Fig. 3
Fig. 4
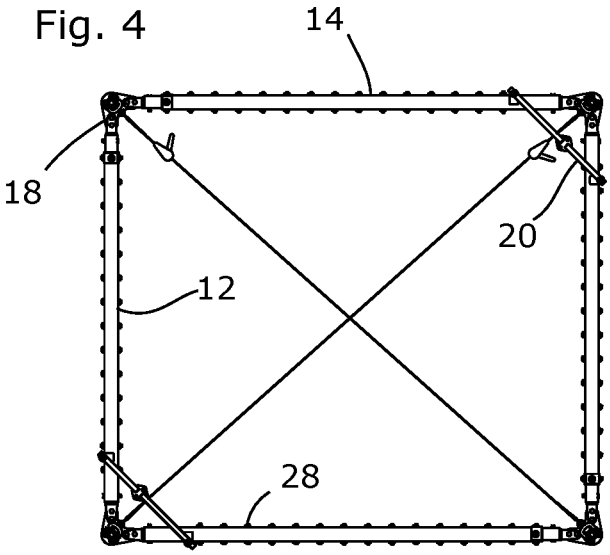

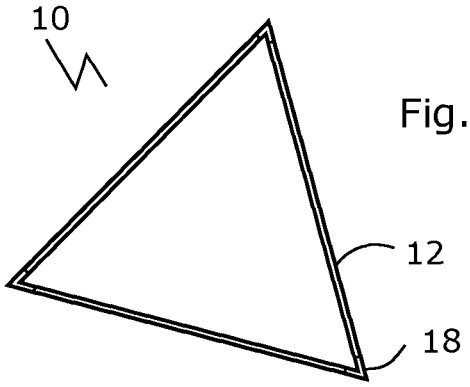
Fig. 23
Fig. 24
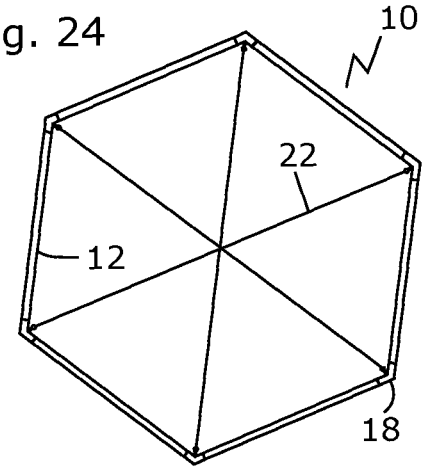
Fig. 25
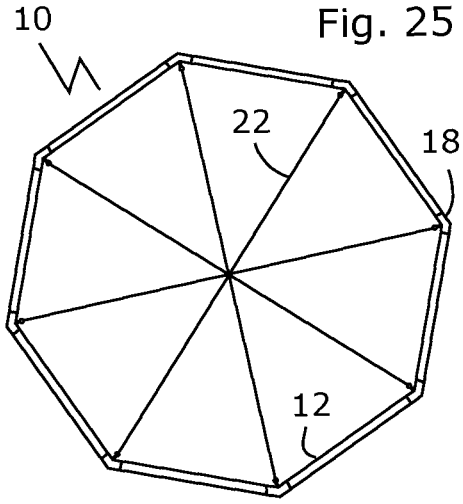
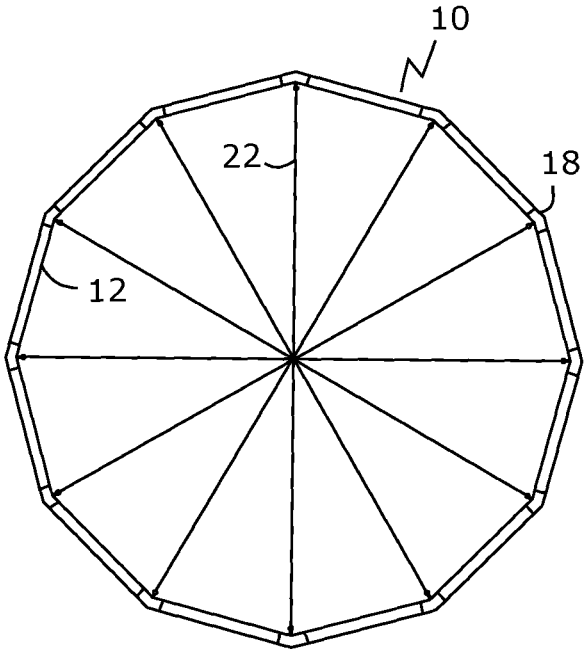
Fig. 26

SPREADER FRAME

TECHNICAL FIELD

The present invention relates to spreader frames.

BACKGROUND

Spreader frames and spreader bars can be used when lifting a load suspended from two or more points. Spreader frames operate to provide a rigid frame by which cables used for hoisting loads may be spread. Spreader frames can serve to provide additional stability during hoisting of large loads and can adjust the distribution of forces upon the load being lifted.

SUMMARY

A spreader frame, the spreader frame having a size that is adjustable, the spreader frame comprising plural beams connected lengthwise to form a frame, each beam comprising an outer bar and a corresponding inner bar, each outer bar having a series of apertures and each inner bar having a spring-biased pin shaped and oriented to displaceably engage any aperture of the series of apertures; each inner bar slidably engaging each corresponding outer bar to form one of the plural beams, each beam of the plural beams being expandable and having a first end, a second end and a length extending between the first end and second end; and for each beam of the plural beams, each aperture of the series of apertures other than a selected aperture is removably blocked, and the inner bar is slidable within the outer bar to bring the spring-biased pin in position to insert into the selected aperture to fix the length of the beam and the size of the spreader frame.

In various embodiments, there may be included any one or more of the following features: the plural beams are connected by corner assemblies that permit relative rotation of the plural beams between a folded position and an unfolded position of the spreader frame; the plural beams are connected lengthwise to each other by plural corner assemblies; each corner assembly of the plural corner assemblies has a first joint connected to a first adjacent beam and a second joint connected to a second adjacent beam, the first adjacent beam is rotatable relative to the corner assembly around the first joint in the folded position and the second adjacent beam is fixed relative to the corner assembly in the folded position; the first joint comprises a first flange, a first fastener passing through a first opening in the first flange and a second fastener passing through a second opening in the first flange, the second fastener being more easily removed than the first fastener, and the second joint comprises a second flange, and a pair of fasteners, each fastener of the pair of fasteners passing through a corresponding opening in the second flange; each corner assembly has a lifting ring for attaching the frame to lifting equipment; the lifting ring is rotatable to bring the lifting ring to an optimal angle for lifting; each aperture of the series of apertures other than a selected aperture is removably blocked by an outer bar pin; the outer bar pin is threaded to form a bolt; the frame comprises four beams connected lengthwise; the selected aperture is displaceably engaged by the spring-biased pin; plural bracing bars, each bracing bar of the plural bracing bars being connected to adjacent beams of the plural beams in the unfolded position of the spreader frame; bracing bar comprises a pair of connecting bars which in a first configuration connect to form a brace for the spreader frame in the unfolded position of the spreader frame; connecting bars in a second configuration connect to prevent the spreader frame from moving into the unfolded position; outer bar pins are bolts; the outer bar pins are threaded; the spreader frame is rectangular or square in the unfolded position; tension straps or cables connect opposing corner assemblies; in which there are three beams; in which there are six beams; in which there are eight beams; in which there are twelve beams.

A spreader bar system, comprising: an outer bar and an inner bar, the outer bar having a series of apertures and the inner bar having a spring-biased pin shaped and oriented to fit into any aperture of the series of apertures; and the outer bar slideably engaging with the inner bar to form an expandable beam having a first end and a second end, wherein each aperture of the series of apertures other than a selected aperture is filled with a corresponding outer bar pin, and the inner bar is slideable to bring the spring-biased pin in position to insert into the selected aperture to fix the size of the beam.

A method of using a spreader frame having plural beams connected by corner assemblies, the corner assemblies having joints that permit relative rotation of the plural beams, the plural beams comprising outer bars and corresponding inner bars, each outer bar having a set of apertures and each inner bar having a spring-biased pin shaped and oriented to displaceably engage any aperture of the series of apertures, each inner bar slidably engaging each corresponding outer bar to form one of the plural beams, each beam of the plural beams being expandable, and for each beam of the plural beams each aperture of the series of apertures other than a selected aperture is removably blocked and the inner bar is slidable within the outer bar to bring the spring-biased pin in position to insert into the selected aperture to fix the length of the beam and the size of the spreader frame, comprising steps of: elevating a portion of the frame such that at least one beam is oriented upwardly; and raising the portion of the frame to slide the inner bar and outer bar of the at least one beam relative to each other.

In various embodiments, there may be included any one or more of the following features: the step of removing an outer bar pin from an aperture; the step of inserting an outer bar pin into an aperture; the step of lowering the spreader frame after the spring-biased pin inserts into the selected aperture.

In a further embodiment, there is provided a method of positioning a spreader frame for hoisting, the method comprising providing a spreader frame having plural beams connected by corner assemblies, the plural beams having selectable extended length settings, the spreader frame being in an initially shortened position; and raising the spreader frame until at least some of the plural beams have locked into the selectable extended length settings.

A method of using a spreader frame having plural beams connected by corner assemblies, the corner assemblies having joints that permit relative rotation of the plural beams, the plural beams comprising outer bars and corresponding inner bars, each outer bar having a set of apertures and each inner bar having a spring-biased pin shaped and oriented to displaceably engage any aperture of the series of apertures, each inner bar slidably engaging each corresponding outer bar to form one of the plural beams, each beam of the plural beams being expandable, and for each beam of the plural beams each aperture of the series of apertures other than a selected aperture is removably blocked and the inner bar is slidable within the outer bar to bring the spring-biased pin in position to insert into the selected aperture to fix the length of the beam and the size of the spreader frame, wherein the spring-biased pins engage the selected apertures and the spreader frame is in a rectangular or square unfolded position, comprising the steps of: removing a fastener of at least one joint of each corner assembly; displacing at least one of the spring-biased pins from a corresponding one of the selected apertures; and allowing the inner bar or outer bar of the at least one beam to slide towards the corresponding outer bar or inner bar under the influence of gravity.

In a further embodiment there is provided the following feature: the step of rotating each beam to cause beams on opposing sides of the rectangular or square position to move towards each other.

A method of positioning a spreader frame for hoisting, the method comprising: providing a spreader frame having plural beams connected by corner assemblies, the plural beams having selectable extended length settings, the spreader frame being in an initially shortened position; and raising the spreader frame until at least some of the plural beams have locked into the selectable extended length settings.

In various embodiments, there may be included any one or more of the following features: the spreader frame has a folded position, and the method further comprising unfolding the spreader frame from the folded position by rotation of at least some of the plural beams around the corner assemblies.

A method of unfolding a spreader frame, the method comprising: providing a spreader frame having a first pair of opposing beams and a second pair of opposing beams, each beam of the first pair of opposing beams being connected to both beams of the second pair of opposing beams by first and second pairs of corner assemblies, and each beam of the second pair of opposing beams being connected to both beams of the first pair of opposing beams by corner assemblies, each beam of the first and second pairs of opposing beams having selectable extended length settings, each beam of the first and second pairs of beams being in an initially shortened position; hoisting the spreader frame into the air so that the first pair of opposing beams is in a near vertical orientation; allowing the first pair of opposing beams to move into the selectable extended length setting under influence of gravity; lowering the spreader frame to a working height; locking the first pair of corner assemblies; hoisting the spreader frame into the air so that the second pair of opposing beams is in a near vertical orientation; allowing the second pair of opposing beams to move into the selectable extended length setting under the influence of gravity; and locking the second pair of corner assemblies.

In various embodiments, there may be included any one or more of the following features: locking the first and second pairs of corner assemblies comprises inserting a fastener into a corner assembly socket to prevent rotation of adjacent beams; locking the first and second pairs of corner assemblies comprises inserting connecting bar pins into sockets of pairs of connecting bars; the step of installing a pair of ratcheting tension straps; the step of hooking slings on each corner assembly of the first and second pairs of corner assemblies; each beam of the first and second pairs of opposing beams comprises a spring-biased pin engaged in a corresponding aperture, and the method further comprises the steps of displacing the spring-biased pin in each beam of the first pair of opposing beams from the corresponding aperture, and displacing the spring-biased pin in each beam of the second pair of opposing beams from the corresponding aperture.

A method of folding a spreader frame, the method comprising: providing a spreader frame having a first pair of opposing beams and a second pair of opposing beams, each beam of the first pair of opposing beams being connected to both beams of the second pair of opposing beams by first and second pairs of corner assemblies, and each beam of the second pair of opposing beams being connected to both beams of the first pair of opposing beams by corner assemblies, each beam of the first and second pairs of opposing beams selectable folded length settings, each beam of the first and second pairs of beams being in an initially unfolded configuration; hoisting the spreader frame into the air so that the first pair of opposing beams is in a near vertical orientation; allowing the first pair of opposing beams to move into the selectable folded length setting under influence of gravity; lowering the spreader frame to a working height; unlocking the first pair of corner assemblies; hoisting the spreader frame into the air so that the second pair of opposing beams is in a near vertical orientation; allowing the second pair of opposing beams to move into the selectable folded length setting under the influence of gravity; lowering the spreader frame to a working height; unlocking the second pair of corner assemblies; and allowing the spreader frame to fold under the influence of gravity.

In various embodiments, there may be included any one or more of the following features: unlocking the first and second pairs of corner assemblies comprises removing connecting bar pins from sockets of pairs of connecting bars; the step of removing a pair of ratcheting tension straps; the step of removing slings from each corner assembly of the first and second pairs of corner assemblies; each beam of the first and second pairs of opposing beams comprises a spring-biased pin engaged in a corresponding aperture, and the method further comprises the steps of: displacing the spring-biased pin in each beam of the first pair of opposing beams from the corresponding aperture, and displacing the spring-biased pin in each beam of the second pair of opposing beams from the corresponding aperture.

These and other aspects of the device and method are set out in the claims, which are incorporated here by reference.

BRIEF DESCRIPTION OF THE FIGURES

Embodiments will now be described with reference to the figures, in which like reference characters denote like elements, by way of example, and in which:

FIG. 3 is a top plan view of a spreader frame in an operating configuration with one pair of opposing beams extended.

FIG. 4 is a top plan view of a spreader frame in an operating configuration with beams unfolded but not extended.

FIG. 23 is a plan view of a spreader frame having three beams.

FIG. 24 is a plan view of a spreader frame having six beams.

FIG. 25 is a plan view of a spreader frame having eight beams.

FIG. 26 is a plan view of a spreader frame having twelve beams.

DETAILED DESCRIPTION

Immaterial modifications may be made to the embodiments described here without departing from what is covered by the claims.

Figure 1:
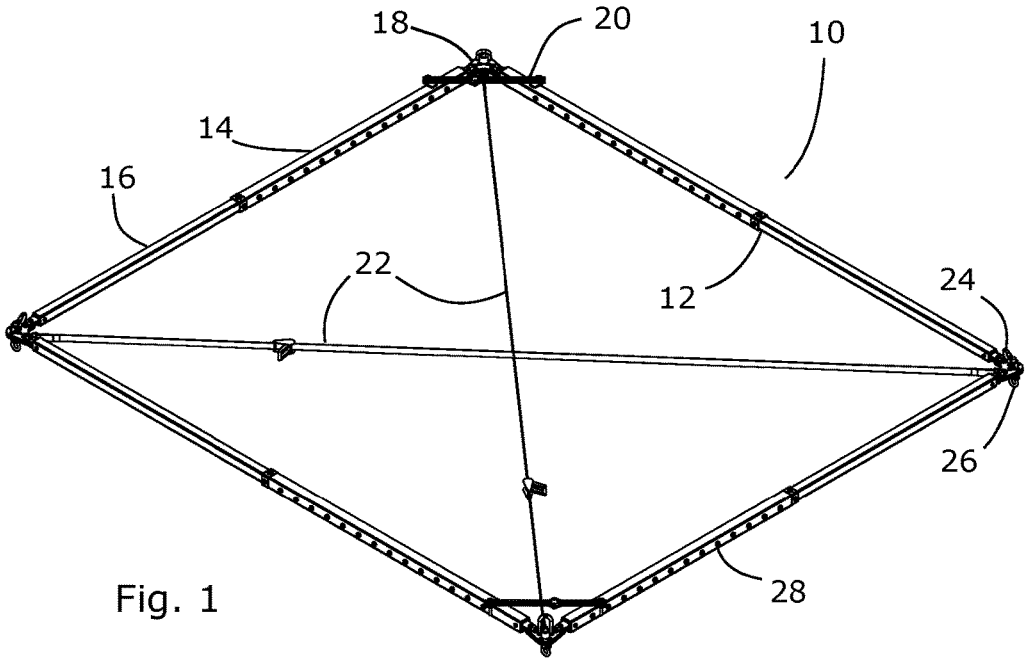
FIG. 1 is an isometric view of a spreader frame in an extended operating configuration.
Figure 2:
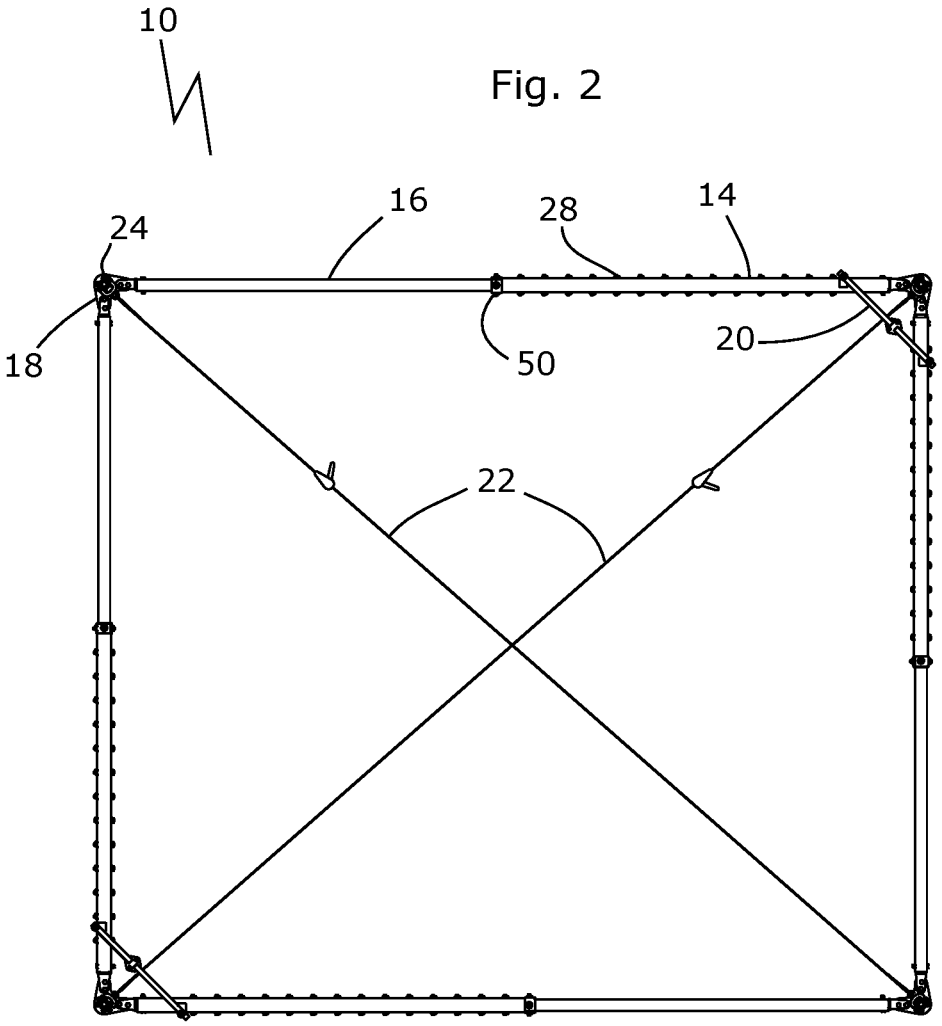
FIG. 2 is a top plan view of the spreader frame shown in FIG. 1.

Referring to FIGS. 1 and 2 there is shown a representative embodiment of a spreader frame 10 in an expanded, or open, configuration. In the extended configuration four beams 12 are arranged in a rectangular formation such that adjacent beams may be perpendicular to each other and opposing beams may parallel to each other. Each beam 12 includes an outer bar 14 and an inner bar 16. Each inner bar 16 is able to slide within the outer bar 14 in a lengthwise direction such that each beam 12 is expandable. At each of the four corners, two beams are connected by corner assemblies 18. While the representative embodiment shows four beams in a rectangular formation, any number of beams greater than or equal to three could be used. For example, configurations using 3, 6, 8 or 12 beams might be used in some circumstances.

Figure 12:
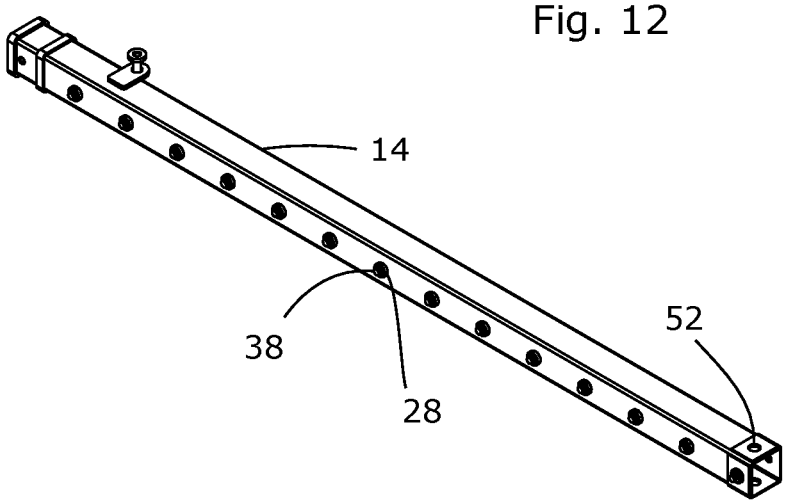
FIG. 12 is an isometric view of an outer bar of a beam of a spreader frame.
Figure 13:
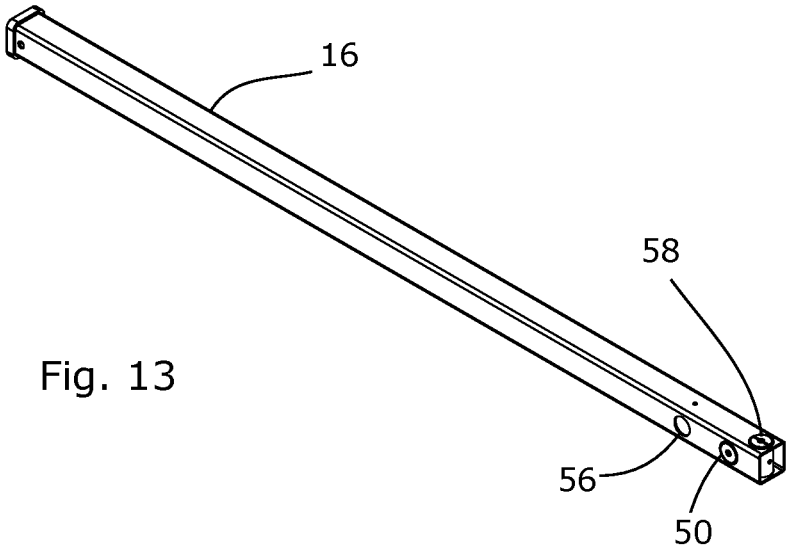
FIG. 13 is an isometric view of an inner bar of a beam of a spreader frame.

Referring now to FIGS. 12-13, each outer bar 14 include one or more apertures 28 and outer bar pins 38. The outer bar pins 38 fill apertures 28 and may be removed to leave open the apertures 28. Outer bar pins 38 may be bolts or screws and may threadably engage the apertures 28. Each inner bar includes at least one spring-biased pin 50 which is shaped and aligned to fit into the apertures 28. Outer bars 14 slidably engage with inner bars 16 to allow inner bars 16 to retract within the outer bars 14. Inner bars can extend out of outer bars in a telescoping arrangement to form expandable beam 12. In some embodiments, all beams may be the same length. In other embodiments adjacent beams may be of differing lengths and opposite beams may be of the same length, such that the frame spreader can form a rectangular formation with two short beams and two long beams without extending inner bars out of outer bars.

Figure 5:
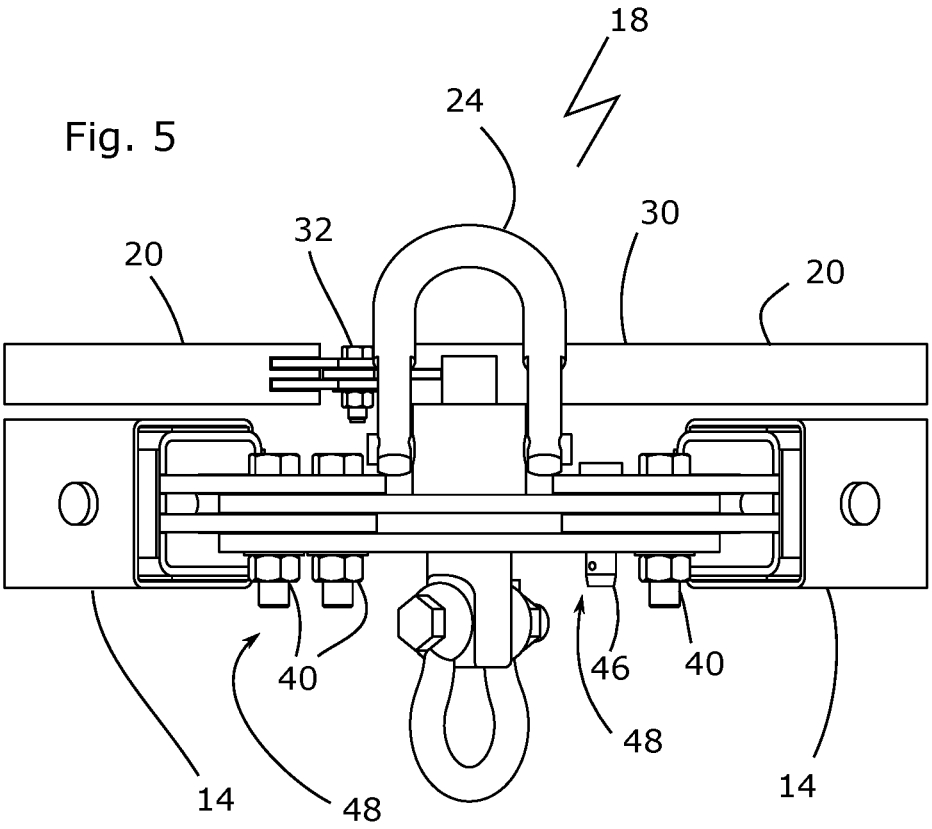
FIG. 5 is an elevation view of a corner assembly with a bracing bar.
Figure 6:
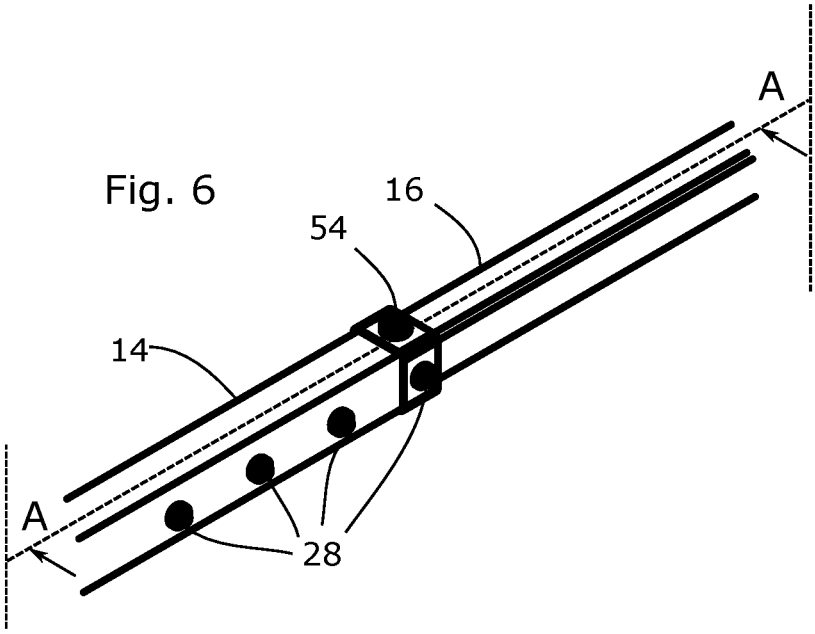
FIG. 6 is an isometric view of the inner bar extending out of an outer bar.
Figure 10:
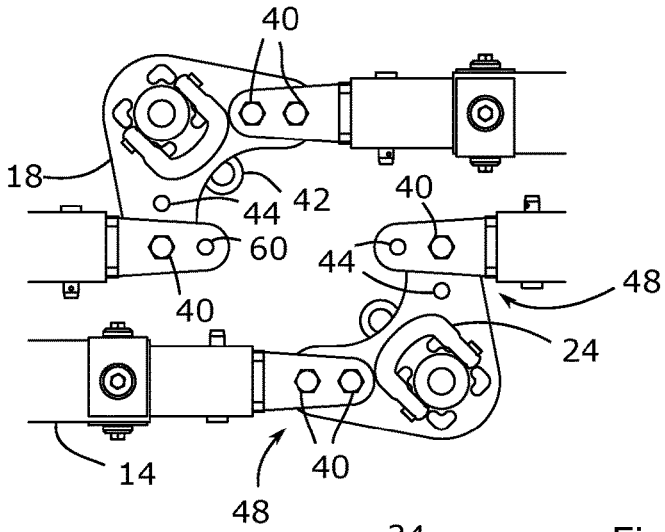
FIG. 10 is a top plan view of two spreader frame corner assemblies, without bracing bars, in a folded configuration.
Figure 11:
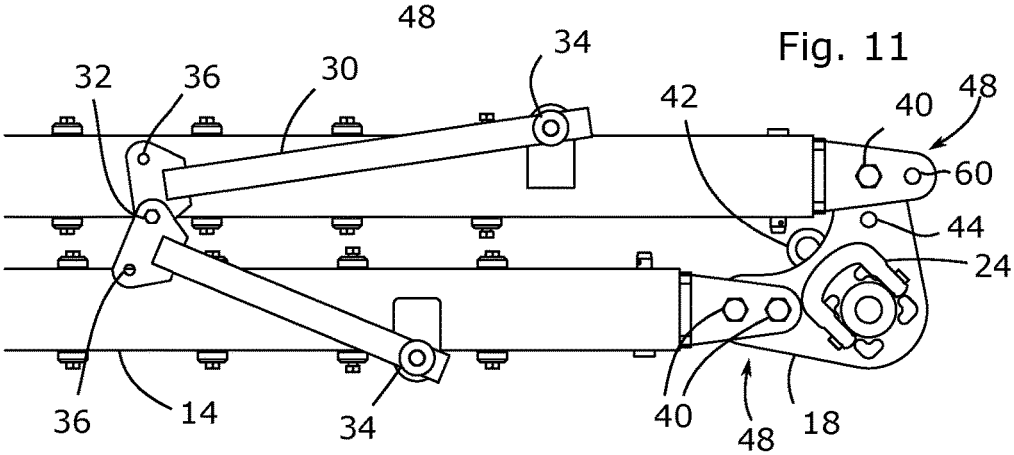
FIG. 11 is a top plan view of a spreader frame corner assemblies, with a bracing bar, in a folded configuration.
Figure 14:
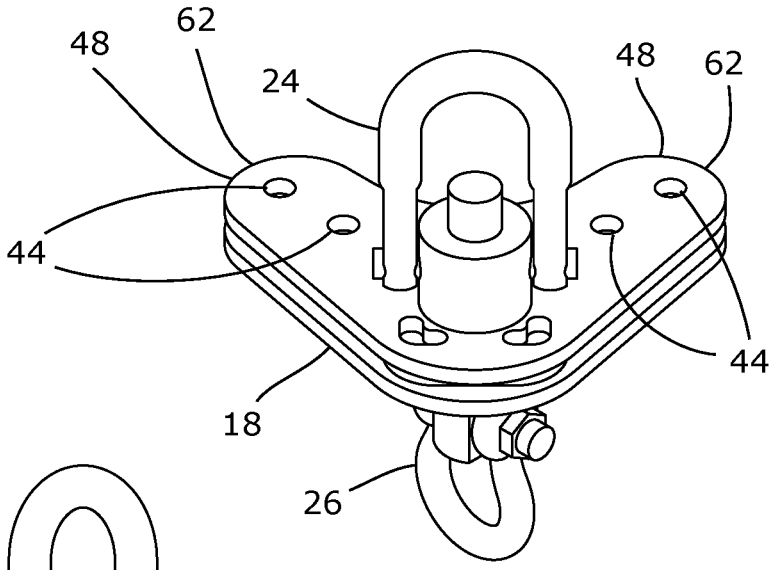
FIG. 14 is an isometric view of a corner assembly of a spreader frame.
Figure 15:
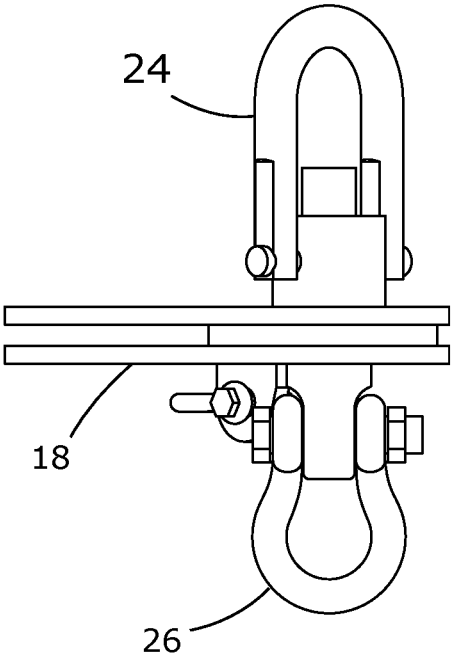
FIG. 15 is an elevation view of a corner assembly of a spreader frame with a right-oriented lifting ring.
Figure 16:
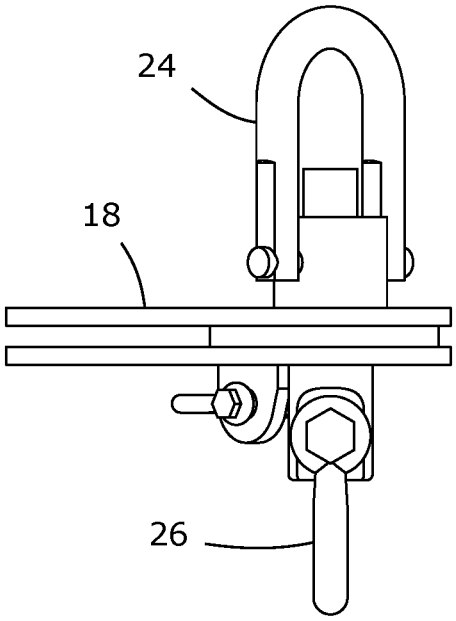
FIG. 16 is an elevation view of a corner assembly of a spreader frame with a left-oriented lifting ring.
Figure 17:
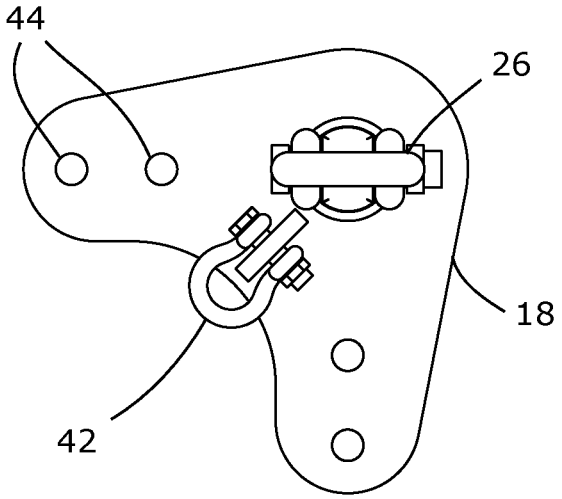
FIG. 17 is a bottom plan view of a corner assembly of a spreader frame with a left-oriented lifting ring.
Figure 18:
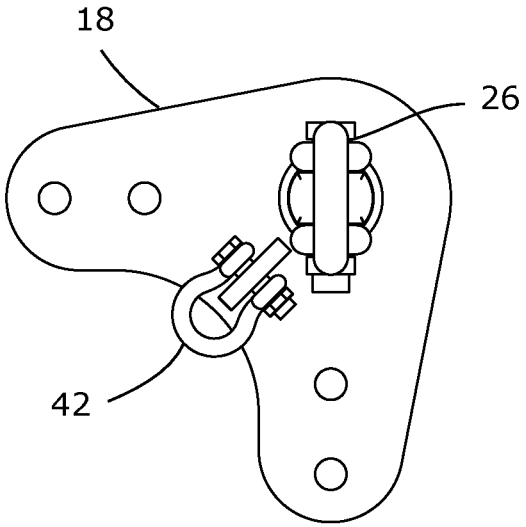
FIG. 18 is a bottom plan view of a corner assembly of a spreader frame with a right-oriented lifting ring.
Figure 19:
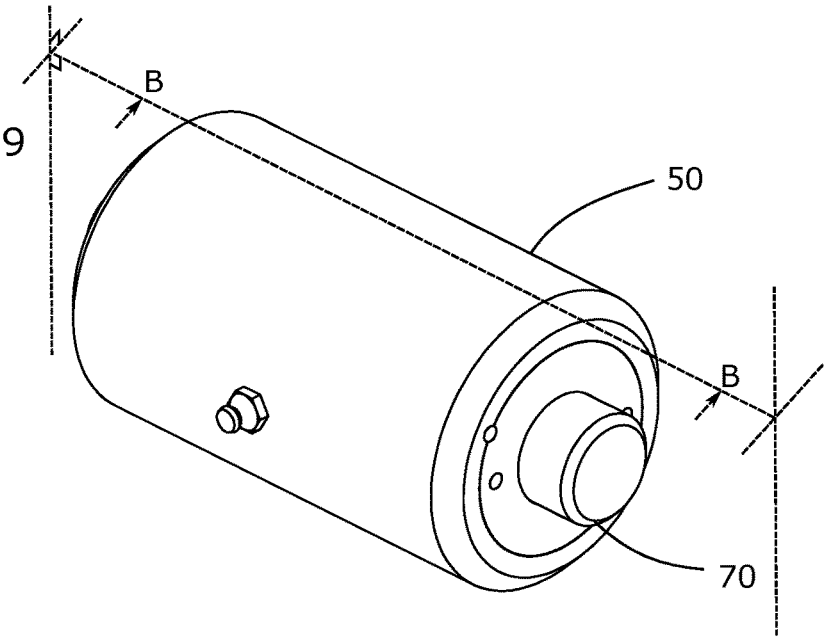
FIG. 19 is an isometric view of a spring-biased pin of an embodiment of a spreader frame.
Figure 20:
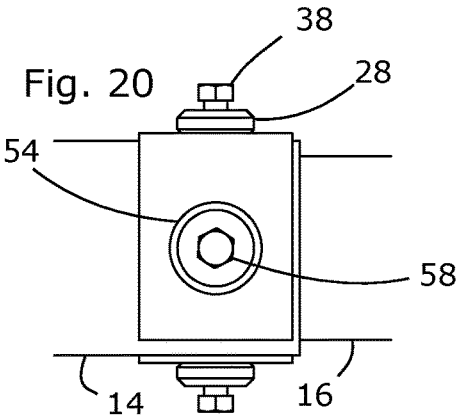
FIG. 20 is an elevation view depicting the inner and outer bars shown in FIG. 6.
Figure 21:
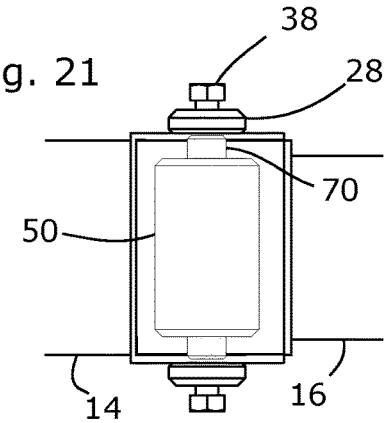
FIG. 21 is a cross-section elevation view depicting the inner and outer bars shown in FIG. 6, along section line A-A.
Figure 22:
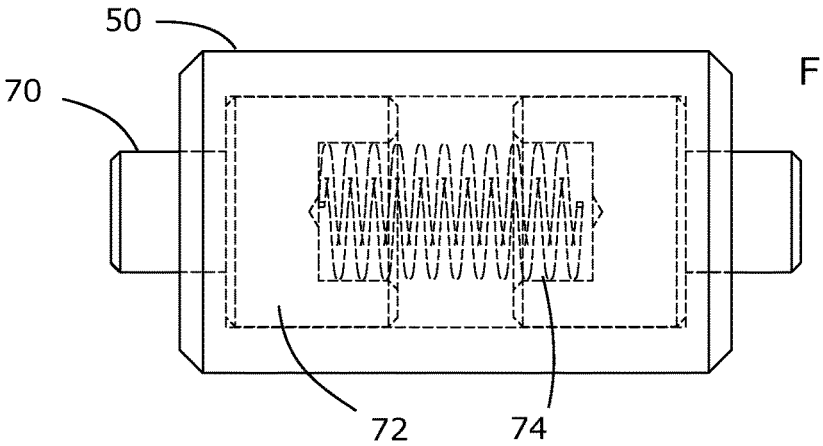
FIG. 22 is a cross-section elevation view of the spring-biased pin depicted in FIG. 19 along section line B-B.

The beams 12 are connected lengthwise to each other by corner assemblies. Each corner assembly 18 is connected to adjacent beams 12 by a pair of joints 48. Referring to FIGS. 10-11 and 14, in the folded configuration each joint 48 of the corner assemblies 18 has a flange 62 including three fasteners 40 inserted into four corner assembly sockets 44. The empty fourth corner assembly socket 44 allows one of the adjacent beams 12 to pivot relative to the corner assembly 18, and therefore allows each beam to pivot relative to adjacent beams. In the unfolded configuration, beam socket 60 and the remaining empty corner assembly socket 44 will align, allowing the insertion of a fastener 46 (see FIG. 5). Fasteners 40 and 46 may be bolts or screws and may be threaded. Inserting a fastener 46 into corner assembly socket 44 prevents rotation of the corresponding beam 12 relative to the corner assembly 18, thereby securing the spreader frame 10 in the expanded configuration. Fastener 46 may be a fourth corner assembly securing bolt 40. In another embodiment, fasteners 40 are bolts secured with a nut while fastener 46 may be a pin or screw and therefore be more easily removed than fasteners 40.

Corner assemblies 18 can each include a lifting ring 24 and a hoisting ring 26. In the embodiment shown, lifting rings 24 are configured to swivel along the axis defined by a line between the lifting ring 24 and the center of the rectangle defined by beams 12. Allowing the lifting rings 24 to swivel ensures that forces transmitted by hoisting cables (not shown) may be pass through the longitudinal length of the lifting ring 24, thereby reducing the lateral forces on the lifting ring 24, regardless of the angle at which the hoisting cables meet the corner assembly. In various embodiments each of lifting rings 24 and hoisting rings 26 may be configured to be able to rotate with respect to their respective corner assembly 18 with one or more angular degrees of freedom.

In the expanded configuration, tension straps or cables 22 may be employed to connect opposing corner assemblies 18. Each corner assembly may include an anchor shackle bolt 42 to which the tension straps 22 can be secured. When using the spreader frame 10 tensions straps 22 may be tightened to provide additional stability to the structure of the spreader frame. In the embodiment shown tensions straps 22 are ratcheting tensions straps but any of a variety of tensions straps or cables could be used to similar effect.

Figure 9:
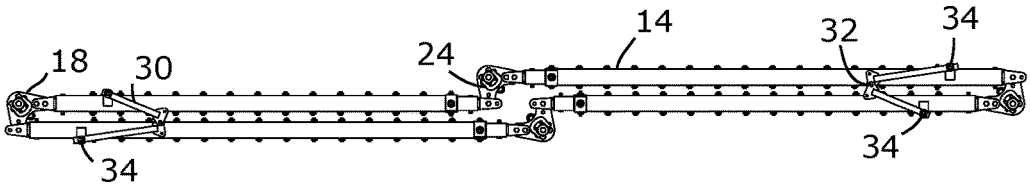
FIG. 9 is a top plan view of a spreader frame in a folded configuration.

Referring now to FIGS. 9-11, there is shown a folded, or closed, configuration of the spreader frame. In this configuration, inner bars 16 are retracted within outer bars 14. Each bracing bar 20 includes two connecting bars 30 secured to outer bars 14 by connecting bar joints 34 so as to allow rotation around the outer bars 14.

As shown in FIGS. 19-22, each spring-biased pin 50 includes at least a spring-biased pin head 70 and a biasing spring 74. The spring-biased pin head has a limited freedom of motion to slide in and out of the spring-biased pin 50. The biasing spring 74 is compressed within the spring-biased pin 50 and applies force to the spring-biased pin head 70 to push it out of the spring-biased pin 50. The spring-biased pin head 70 can be compressed to force the spring-biased pin head 70 further into the spring-biased pin. During operation of the spreader frame 10, if an aperture 28 is left open in an outer bar 14 and the inner bar 16 is allowed to slide within the outer bar 14, then the biasing spring 74 will force the spring-biased pin head 70 into the aperture 28, pinning the inner bar 16 in place with respect to the outer bar 14. In this way, removal of an outer bar pin 38 from an aperture 28 in each beam 12 can determine a selectable extended length setting of each beam 12 of the frame spreader 10.

In operation, the spreader frame 10 may initially be in a folded configuration as shown in FIGS. 9-11. In the folded configuration, inner bars 16 are retracted within outer bars 14. While in the folded configuration, the inner bars 16 are held in place by spring-biased pin 50 engaged in an aperture 28, preventing the inner bars 16 from sliding within outer bars 14.

To unpin the inner bar 16 an operator forces an outer bar pin 38 into the apertures 28 engaged by spring-biased pins 50, thereby displacing the spring-biased pin head 70 from the aperture 28. Unpinning the inner bar 16 allows inner bars 16 to move within outer bars 14. The extension of the beams moves the spreader frame 10 into an expanded configuration (thus in a selectable extended length setting). Prior to unpinning the inner bar 16, the operator may choose to remove an outer bar pin 38 from a selected aperture 28 so that the spring-biased pin 50 will engage with the newly opened aperture 28 as inner bar 16 extends out of the outer bar 14. Engagement of the spring-biased pin 50 with the open aperture 28 of the inner bar prevents the inner bar 16 from extending any further out of the outer bar 14. Additional apertures further down the outer bar from the selected aperture may be left open since the spring-biased pin will engage the first open aperture it passes.

To cause the inner bars 16 to slide within the outer bars 14, parts of the spreader frame may be hoisted so that gravity forces one or more inner bars 16 to extend out of the outer bars 14. The spreader frame 10 may be hoisted so that at least one beam 12 is oriented vertically or near vertically. Lifting the spreader frame 10 may then allow the inner and outer bars to slide relative to each other.

The selection of which outer bar pin 38 to remove from each outer bar 16 is determined by the size and shape of the desired expanded (or unfolded) configuration. If outer bar pins 38 are removed at equivalent positions on each outer bar of a spreader frame with four beams, then in the expanded configuration the spreader frame will form a square (FIG. 2). If the apertures 28 are opened at equivalent positions on opposing outer bars and different positions at adjacent outer bars, then a four beam spreader will form a rectangle in the expanded configuration (FIG. 4). Where a spreader frame has a number of beams greater or less than four, regular and irregular polygons can be produced by similar methods. For example, in a three beam configuration removing outer bar pins at equal distances on all three outer bars would result in an expanded configuration in the shape of an equilateral triangle (see FIG. 23). Having only two of three beams with outer bar pins removed at equal distances would result in an isosceles triangle.

Referring to FIG. 4, it is possible to use the spreader frame 10 without extending the beams 12. Where a smaller spreader frame is required it may be desirable to not extend the inner bars 16 out of the outer bars 14. The spreader frame can be unfolded without removing the spring-biased pins 50 holding the inner bars 16 in place relative to the outer bars 14. The beams can then be secured in the unfolded configuration using connecting bars 20 and securing straps 22.

While in use in the expanded configuration, additional steps may be taken to prevent the spreader frame 10 from folding and to increase the stability of the spreader frame. After expansion of the spreader frame, beam socket 60 and the empty corner assembly socket 44 will align, allowing the insertion of a fastener 46 (see FIG. 5). Inserting a fastener 46 into corner assembly socket 44 prevents rotation of the corresponding beam 12 relative to the corner assembly 18, thereby securing the spreader frame 10 in the expanded configuration. Additionally, securing straps 22 can be employed between opposing anchor shackle bolts 42 on corner assemblies 18.

Figure 7:
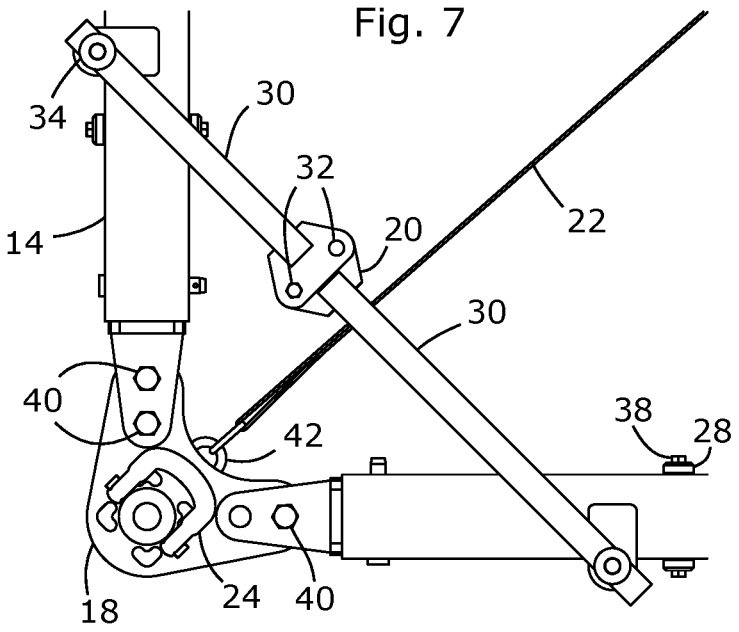
FIG. 7 is a top plan view of a spreader frame corner assembly with a bracing bar.
Figure 8:
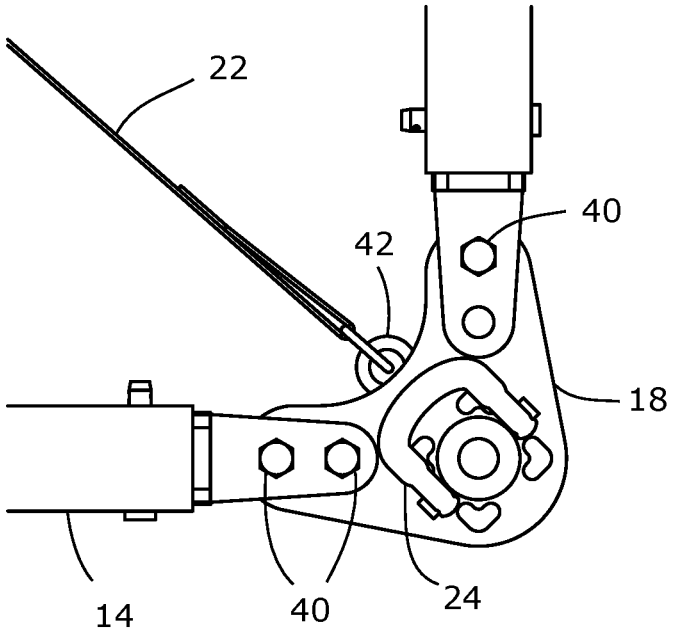
FIG. 8 is a top plan view of a spreader frame corner assembly without a bracing bar.

Referring to FIGS. 7 and 11, bracing bars 20 may be employed at one or more of the corners of the spreader frame. Bracing bars 20 may each comprise two connecting bars 30. Each connecting bar 30 is fixed to an outer bar 14 at a position adjacent to a corner assembly 18 by means of a connecting bar joint 34. The connecting bar joint 34 may allow rotation of the connecting bar 30. The connecting bars have two connecting bar sockets 36 into which connecting bar pins 32 may be inserted. When the spreader frame is in an expanded configuration, the connecting bar pins 32 may be placed in a bracing position in which the connecting bar sockets 36 of both connecting bars 30 are aligned to allow insertion of two connecting bar pins 32. Insertion of the two bar pins 32 prevents rotation of the connecting bars 30 relative to each other, thereby preventing the expanded spreader frame from folding.

In the folded configuration, it is possible to insert one connecting bar pin 32 into one of the two connecting bar sockets 36 so as to secure the two connecting bars 30 while a second connecting bar pin 32 is inserted into a connecting bar socket of only one of the two connecting bars 30. The insertion of the second connecting bar pin 32 prevents the connecting bars 30 from rotating into the full bracing position. In a third configuration, it is possible to insert the two connecting bar pins 32 so that each pin only engages the connecting bar socket 36 of one connecting bar 30. In this third configuration the connecting bars 30 are not secured to each other and can each rotate freely around the connecting bar joints 34.

Each inner bar 16 can include a fail-safe spring-biased pin 52 and each outer bar 14 can include a corresponding fail-safe aperture 54 at one end of the outer bar 14. In a preferred embodiment, the fail-safe spring-biased pin 52 and fail-safe aperture 54 are oriented to be perpendicular to the normal spring-biased pin 50 and apertures 28 in the inner and outer bars. If, during expansion of the spreader frame 10, the spring-biased pin 50 fails to engage the desired aperture 28, then the fail-safe spring-biased pin 52 and fail-safe aperture 54 can provide a second opportunity to stop the inner bar 16 extending further out of the outer bar 14.

After the spreader frame 10 has been unfolded, the spreader frame may be used to lift or hoist loads. Cables may be secured to swivel hoist rings 24 to connect the spreader frame 10 to a lifting mechanism, e.g. a hook suspended from a crane or helicopter (not shown). Additional cables should be secured each with one end attached to lifting rings 26 on the underside of corner assemblies 18 and the other end connecting to the load being lifted.

After the lifting operation has been completed it may be desirable to fold the spreader frame, such as for storage or transportation. To prepare the spreader frame 10 for folding cables should be removed from lifting rings 26 and swivel hoist rings 24. Tension straps 22 should be removed from anchor shackle bolts 42. Fasteners 46 are removed from corner assembly sockets 44 to allow rotation of corresponding beams 12, and a single connecting bar pin 32 is removed from one of the two connecting bar sockets 36 to allow relative rotation of the connecting bars 30. At least one outer bar pin 38 should be removed from an aperture 28 of each outer bar 14 so as to allow the inner bars 16 to lock in place within the outer bars 14 after being retracted. Which outer bar pin 38 is removed is determined by how far it is desired to retract the inner bar 16 into the outer bar 14. If the spreader frame 10 is being folded, then the outer bar pins 38 removed will be from the apertures 28 furthest into the outer bar 14. At this stage, insertion of an outer bar pin 38 into each aperture 28 engaged by a spring-biased pin 50 will displace each spring-biased pin head 70 from the engaged aperture 28, allowing the inner bar 16 to slide within the outer bar 14. Inner bars 16 can then be pushed back into the outer bars 14 until the spring-biased pins 50 engage with the open apertures 28.

A method of retracting the inner bars 16 into the outer bars 14 involves hoisting the spreader frame 10 into the air so that one or more beams 12 are oriented upwardly and may potentially be oriented vertically or near vertically. Lowering the spreader frame 10 can then allow the gravity to force inner bars into outer bars 14. During the folding of the spreader frame, the removed connecting bar pin 32 may be reinserted to engage a connecting bar socket 36 of one of the two connecting bars 30, so as to prevent the connecting bars 30 from rotating back into a bracing position. With the fastener 46 removed, the beams 12 relative to adjacent beams to fold the frame spreader 10 back into the folded configuration. After the spreader frame 10 has been fully folded, the spreader frame may be secured in the folded position, such as by tying beams 12 together in the folded position. Spreader frame may also be placed into a suitably sized container (not shown) for storage or transportation.

In one embodiment, a method of unfolding a spreader frame involves a spreader frame initially packed with accompanying equipment such as tension straps, slings and cables. The spreader frame may be in a container such as a specially designed cradle (not shown) and may be on a surface such as the bed of a trailer. Before unpacking the spreader frame, the straps, slings and cables are removed and placed outside of the container. Connecting bar pins 32 are removed from all bracing bars 20, and an outer bar pin 38 is removed from two opposing beams 12 to determine a selectable expanded length setting. If the desired final shape of the unfolded configuration is to form a rectangle, then the first outer bar pins 38 should be removed from beams 12 that will form the short sides of the rectangle. The removed outer bar pins 38 are each placed in an aperture 28 occupied by a spring-biased pin 50 in the folded configuration, and in the same outer bar 14 from which they were removed, thereby displacing the spring-biased pin and unlocking the corresponding inner bar 16 to move within the outer bar 14. Using the slings and a suitable hoisting apparatus, such as a crane (not shown), the spreader frame 10 can be hoisted in the air and out of the container to allow the first pair of opposing beams to move into the selected extended length setting.

Once the first pair of opposing beams locks into the selected extended length setting, two fasteners 46 are inserted into empty corner assembly sockets 44 in two of the corner assemblies 18 to lock each beam and prevent from rotating relative to one of the adjacent beams. A connecting bar pin 32 may be inserted into one connecting bar socket 34 of each pair of connecting bars 30 to join each pair of connecting bars 30. The spreader frame may be swung away from the container and placed on the ground. Before lowering completely, the two remaining fasteners 46 can be inserted into the empty corner assembly sockets 44 of the two other corner assemblies 18. A second connecting bar pin 32 can then be inserted into a connecting bar pin socket in each pair of connecting bars 30 to fix the bracing bar 20 in a bracing position. The spreader frame 10 should then be lowered to the ground, making sure not to pinch slings. At this stage the spreader frame 10 forms a rectangular configuration with two extended beams and two non-extended beams.

An outer bar pins 38 is then removed from each of the two non-extended beams at the selected extended length setting, and the apertures are inserted into apertures 28 occupied by spring-biased pins 50. Displacement of the spring-biased pins 50 allows the inner bars 16 to move within the outer bars 14. Hoisting the spreader frame again into the air and into a vertical orientation allows the inner bars 16 to extend out of the outer bars 14 until spring-biased pins 50 engage the now open apertures 28 at the selected extended length setting. The frame can then be lowered again to hook up any remaining slings and to allow installation of tensions straps 22. Before using the spreader frame, all pins holes should be visually checked to confirm that all pins are engaged.

In one embodiment, to disassemble the spreader frame the spreader frame is lowered to working height and all rigging is removed from the underside hoisting rings 26. Ratchet straps 22 are loosened, removed and packed away. An outer bar pin 38 is removed from apertures in each of two opposing beams 12. If the spreader frame 10 forms a rectangular shape in the expanded configuration that the two opposing beams 12 should form the longer sides of the rectangular shape. The outer bar pins 38 are removed from apertures 28 in the outer bar 12 at the end of the outer bar at a position that allows the inner bar 16 to fully retract into a selectable folded length setting at which the spring-biased pin 50 engages the opened aperture 28. The removed outer bar pins 38 are then inserted into the apertures 28 engaged by spring-biased pins 50 in the pair of beams, displacing the spring-biased pins 50. Displacing the spring-biased pins 50 allows each inner bar 16 to move with respect to the corresponding outer bar 14.

The spreader frame 10 is then hoisted into an upright orientation in which the two opposing beams are at or near a vertical orientation. Lowering the spreader frame 10 allows the weight of the spreader frame to force the inner beams 16 into outer beams 14. Once inner beams 16 of the opposing beams lock into the corresponding outer beams, two outer bar pins 38 are removed from apertures 28 in the second pair of opposing beams 12. The outer bar pins 38 are removed from apertures 28 in the outer bar 12 at the end of the outer bar 12 opposite the extended inner bar. The removed outer bar pins are then inserted into the apertures 28 engaged by spring-biased pins 50 in the second pair of beams, displacing the spring-biased pins. Displacing the spring-biased pins 50 allows each inner bar 16 to move with respect to the corresponding outer bar. One fastener each is then removed from two opposing corner assemblies 18, and one connecting bar pin 36 from each bracing bar 20. The connecting bars 30 can be knocked out of the bracing position, and the removed connecting bar pins 36 reinserted to engage the connecting bar socket 34 of only one of the two connecting bars 30, thereby preventing the connecting bars 30 from returning to the bracing position.

The spreader frame 10 is then hoisted into an upright orientation in which the second pair of beams are at or near a vertical orientation. Lowering the spreader frame 10 allows the weight of the spreader frame to force the inner beams 16 into outer beams 14. Once inner beams of the 16 of the second pair of beams lock into the corresponding outer beams, the remaining pair of fasteners 46 can be removed, and the second of each pair of connecting bar pins 36 can be removed. The second of each pair of connecting bar pins 36 can be reinserted into an open connecting bar socket 34 of only one of the two connecting bars 30, further preventing the connecting bars 30 from entering the bracing position. The spreader frame 10 can then be swung into the container, and the spreader frame can be moved into the fully folded position. Rigging can then be placed into the container. If the container is a trailer the frame assembly and all rigging should be tied down before transport.

Some embodiments of a spreader frame 10 may use a number of beams 12 greater or less than four. FIGS. 23-26 depict embodiments of spreader frames with 3, 6, 8 and 12 beams respectively. Where the number of beams is an even number tensions straps 22 may be used to reinforce the spreader frame in its unfolded configuration. The number of beams 12 and corner assemblies 18 determines the number of lifting rings 24 and hoisting rings 26 and therefore determine the number of points across which hoisting cables and rigging are spread.

In the claims, the word "comprising" is used in its inclusive sense and does not exclude other elements being present. The indefinite articles "a" and "an" before a claim feature do not exclude more than one of the feature being present. Each one of the individual features described here may be used in one or more embodiments and is not, by virtue only of being described here, to be construed as essential to all embodiments as defined by the claims.

The embodiments of the invention in which an exclusive property or privilege is claimed are defined as follows:

1. A spreader frame, the spreader frame having a size that is adjustable, the spreader frame comprising:

plural beams connected lengthwise to form a frame, each beam comprising an outer bar and a corresponding inner bar, each outer bar having a series of apertures and each inner bar having a spring-biased pin shaped and oriented to displaceably engage any aperture of the series of apertures;

each inner bar slidably engaging each corresponding outer bar to form one of the plural beams, each beam of the plural beams being expandable and having a first end, a second end and a length extending between the first end and second end; and for each beam of the plural beams, each aperture of the series of apertures other than a selected aperture is removably blocked, and the inner bar is slidable within the outer bar to bring the spring-biased pin in position to insert into the selected aperture to fix the length of the beam and the size of the spreader frame.

2. The spreader frame of claim 1 in which the plural beams are connected by corner assemblies that permit relative rotation of the plural beams between a folded position and an unfolded position of the spreader frame.

3. The spreader frame of claim 2 wherein the plural beams are connected lengthwise to each other by plural corner assemblies.

4. The spreader frame of claim 3 in which each corner assembly of the plural corner assemblies has a first joint connected to a first adjacent beam and a second joint connected to a second adjacent beam, the first adjacent beam is rotatable relative to the corner assembly around the first joint in the folded position and the second adjacent beam is fixed relative to the corner assembly in the folded position.

5. The spreader frame of claim 4 in which the first joint comprises a first flange, a first fastener passing through a first opening in the first flange and a second fastener passing through a second opening in the first flange, the second fastener being more easily removed than the first fastener, and the second joint comprises a second flange, and a pair of fasteners, each fastener of the pair of fasteners passing through a corresponding opening in the second flange.

6. The spreader frame of claim 2 wherein each corner assembly has a lifting ring for attaching the frame to lifting equipment.

7. The spreader frame of claim 6 wherein the lifting ring is rotatable to bring the lifting ring to an optimal angle for lifting.

8. The spreader frame of claim 2 further comprising plural bracing bars, each bracing bar of the plural bracing bars being connected to adjacent beams of the plural beams in the unfolded position of the spreader frame.

9. The spreader frame of claim 8 wherein each bracing bar comprises a pair of connecting bars which in a first configuration connect to form a brace for the spreader frame in the unfolded position of the spreader frame.

10. The spreader frame of claim 9 wherein the connecting bars in a second configuration connect to prevent the spreader frame from moving into the unfolded position.

11. The spreader frame of claim 2 in which the spreader frame is rectangular or square in the unfolded position.

12. The spreader frame of claim 11 further comprising tension straps or cables connecting opposing corner assemblies.

13. The spreader frame of claim 1 wherein each aperture of the series of apertures other than a selected aperture is removably blocked by an outer bar pin.

14. The spreader frame of claim 13 in which the outer bar pin is threaded to form a bolt.

15. The spreader frame of claim 13 wherein the outer bar pins are bolts.

16. The spreader frame of claim 13 wherein the outer bar pins are threaded.

17. The spreader frame of claim 1 wherein the frame comprises four beams connected lengthwise.

18. The spreader frame of claim 1 wherein the selected aperture is displaceably engaged by the spring-biased pin.

19. A spreader bar system, comprising:

an outer bar and an inner bar, the outer bar having a series of apertures and the inner bar having a spring-biased pin shaped and oriented to fit into any aperture of the series of apertures; and the outer bar slideably engaging with the inner bar to form an expandable beam having a first end and a second end, wherein each aperture of the series of apertures other than a selected aperture is filled with a corresponding outer bar pin, and the inner bar is slideable to bring the spring-biased pin in position to insert into the selected aperture to fix the size of the beam.

20. A method of folding a spreader frame, the method comprising:

providing a spreader frame having a first pair of opposing beams and a second pair of opposing beams, each beam of the first pair of opposing beams being connected to both beams of the second pair of opposing beams by first and second pairs of corner assemblies, and each beam of the second pair of opposing beams being connected to both beams of the first pair of opposing beams by corner assemblies, each beam of the first and second pairs of opposing beams having selectable folded length settings, each beam of the first and second pairs of beams being in an initially unfolded configuration;

hoisting the spreader frame into the air so that the first pair of opposing beams is in a near vertical orientation;

allowing the first pair of opposing beams to move into the selectable folded length setting under influence of gravity;

lowering the spreader frame to a working height;

unlocking the first pair of corner assemblies;

hoisting the spreader frame into the air so that the second pair of opposing beams is in a near vertical orientation;

allowing the second pair of opposing beams to move into the selectable folded length setting under the influence of gravity;

lowering the spreader frame to a working height;

unlocking the second pair of corner assemblies; and allowing the spreader frame to fold under the influence of gravity.

* * * * *